US006539581B1

(12) United States Patent
Faringosi

(10) Patent No.: US 6,539,581 B1
(45) **Date of Patent: *Apr. 1, 2003**

(54) HINGE FOR FURNITURE AND THE LIKE, WITH MOVABLE ARM ARRANGED INSIDE THE FIXED ARM

(75) Inventor: Alvaro Faringosi, Milan (IT)

(73) Assignee: Faringosi-Hinges S.r.l., Milan (IT)

( * ) Notice: Subject to any disclaimer, the term of this patent is extended or adjusted under 35 U.S.C. 154(b) by 0 days.

This patent is subject to a terminal disclaimer.

(21) Appl. No.: 09/538,546

(22) Filed: Mar. 29, 2000

(30) Foreign Application Priority Data

Mar. 30, 1999 (IT) ..... MI99A0651

(51) Int. Cl.[7] ..... E05D 11/10
(52) U.S. Cl. ..... 16/327; 49/465; 126/194
(58) Field of Search ..... 16/327, 254, 270, 16/271, 352; 126/194, 191, 197; 49/465, 386, 394, 463; 110/173 R; 248/221.11

(56) References Cited

U.S. PATENT DOCUMENTS

| | | | | | |
|---|---|---|---|---|---|
| 3,123,064 | A | * | 3/1964 | Hartson | 126/191 |
| 3,144,863 | A | * | 8/1964 | Pollock | 126/191 |
| 3,299,879 | A | * | 1/1967 | Doner | 126/194 |
| 3,327,701 | A | * | 6/1967 | Smith | 126/194 |
| 3,677,259 | A | * | 7/1972 | Doner | 126/194 |
| 3,889,654 | A | * | 6/1975 | Kauranen et al. | 126/194 |
| 5,025,776 | A | * | 6/1991 | Hanley et al. | 126/194 |
| 5,291,634 | A | * | 3/1994 | Zanetti | 16/333 |
| 5,822,925 | A | * | 10/1998 | McKinney et al. | 126/194 |
| 5,881,710 | A | * | 3/1999 | Davis et al. | 126/194 |
| 6,035,848 | A | * | 3/2000 | Ray et al. | 126/194 |

FOREIGN PATENT DOCUMENTS

| | | | |
|---|---|---|---|
| EP | 0738817 | 10/1996 | |
| EP | 738817 | * 10/1996 | E05F/1/12 |
| EP | 744521 | * 11/1996 | E05D/3/06 |
| EP | 748987 | * 12/1996 | F24C/15/02 |
| EP | 0872692 | 10/1998 | |
| FR | 2398165 | 2/1979 | |

* cited by examiner

*Primary Examiner*—Anthony Knight
*Assistant Examiner*—Doug Hutton
(74) *Attorney, Agent, or Firm*—Ladas & Parry

(57) ABSTRACT

Hinge for connecting doors (1*b*) to ovens (1,1*a*) and the like, which comprises a fixed arm (11) engageable with the body of the oven, a movable part (21) which is hinged on said fixed arm (11) and on which one end (23*b*) of a movable arm (23) is pivotably mounted, there being provided means (15) for fastening the movable arm (23) to the fixed arm (11), said fixed arm (11) having a cross-section in the form of an overturned "U", between the walls of which there is arranged an idle roller (25), and said movable arm (23) being arranged inside said fixed arm.

8 Claims, 2 Drawing Sheets

HINGE FOR FURNITURE AND THE LIKE, WITH MOVABLE ARM ARRANGED INSIDE THE FIXED ARM

The present invention relates to a hinge for connecting doors to associated ovens and the like, which comprises a fixed arm pivotably mounted on the hinge part integral with the door and engageable with the body of the oven, a movable arm in turn pivotably mounted on said movable hinge part and movable inside the fixed arm, and means which can be manually operated for locking the movable arm to the fixed arm, so as to allow the door to be pulled out in safe conditions.

It is known in the technical sector relating to the production of hinges for connecting the doors closing ovens, electric household appliances, furniture and the like, of the need to manufacture said hinges as two parts, one of which is integral with the oven or like and the other integral with the door for closing the same, so that it is possible to arrange the said door in stable positions where it is closed, partially open for ventilating the oven during cooking with the spit, or totally open, as well as in a stable position where it is possible to separate the door, together with its hinge part, from the oven, while ensuring safety conditions which prevent injury to the user.

Hinges designed to solve these problems are known, for example, from MI97U 278 in the name of the same Applicant, which describes a hinge for connecting doors to ovens and the like, which comprises a fixed arm which is engageable with the oven body and has a cross-section in the form of an overturned "U", between the walls of which an idle roller is arranged, and in which the movable arm is arranged inside fixed arm.

While solving the drawback of the preceding hinges in which the movable arm remained above the fixed arm with the consequent need to provide special configurations for both of them, designed to prevent trapping of the operator's fingers, said hinge of the known type, although functional, still has the drawback of having the element for relative locking of the two arms in an exposed position which may be the cause of drawbacks for the user during operation in order to pull out the door from its seat.

The technical problem which is posed, therefore, is that of providing a hinge for the doors of ovens, electric household appliances, furniture and the like, which allows said door to be positioned in various stable open positions, allows the possibility of easy and safe separation of the door from the body of the oven or the like and, at the same time, does not have a movable arm which is visible.

Within the scope of this problem a further need is that said hinge should have small dimensions, be easy and economical to assemble and applicable also to doors of the known type without the need for special adaptation of either part.

A further object is to provide the hinge with means for relative fastening of the fixed arm and the movable arm, which means are in a protected position, but are easily accessible and do not allow random and unintentional operation by the user.

In addition to this, there is the need to obtain a movement of the movable arm of the hinge which is as controlled as possible so as to allow a reduction in the load of the compensating springs with consequent easier operation by the user.

These technical problems are solved according to the present invention by an improved hinge for connecting doors to ovens and the like, which comprises a fixed arm engageable with the body of the oven, a movable part which is hinged on said fixed arm and on which one end of a movable arm is pivotably mounted, and means for fastening the movable arm to the fixed arm, said fastening means being movable from a position disengaged from an element of the movable arm to a position engaged with said element so as to allow extraction of the hinge together with the door.

Further details may be obtained from the following description of a non-limiting example of embodiment of the invention provided with reference to the accompanying drawings, in which.

Figure 1:
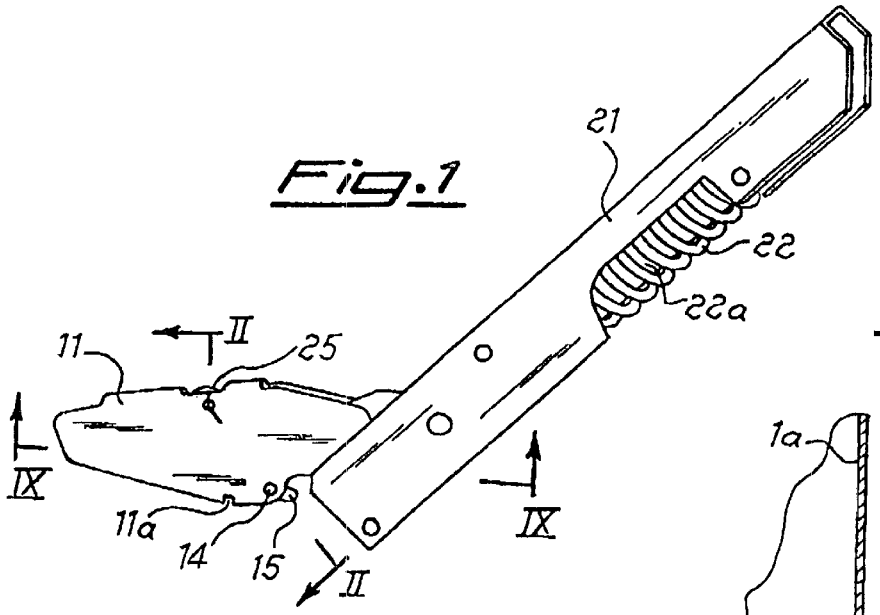
FIG. 1 shows a perspective view of the hinge according to the invention.
Figure 9:
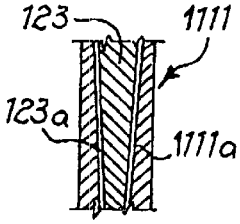
Figure 8A:
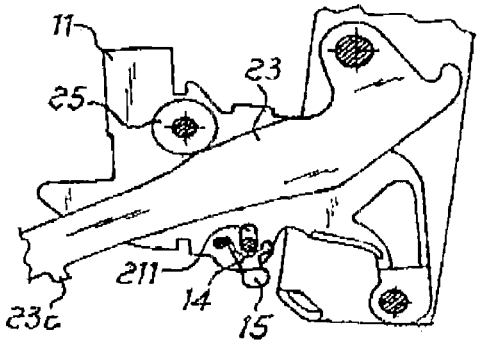
Figure 8B:
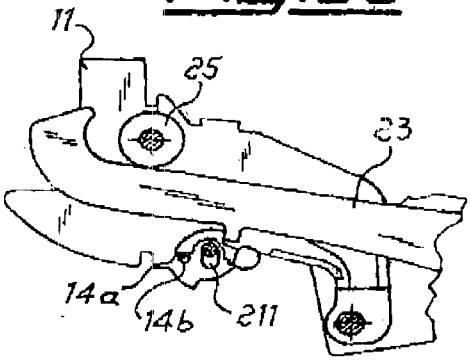

FIG. 8*a* shows a partially sectioned side view of the detail of a further embodiment of the element for relative fastening of the two arms in the non-operating position;

FIG. 8*b* shows a view similar to that of FIG. 8*a* with element for relative fastening of the two arms in the engaged position for extraction of the hinge; and FIG. 9 shows a partial section along the plane indicated by IX—IX in FIG. 1 of the detail of the fixed arm and the movable arm of the hinge in an embodiment designed to control the travel of the movable arm.

Figure 3:
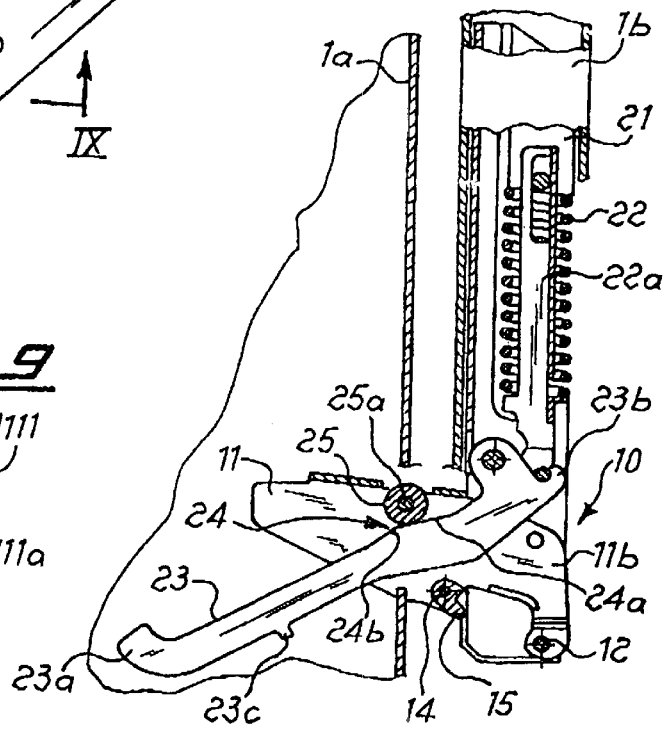
FIG. 3 shows a partially sectioned view of the hinge according to the invention applied to a door in the closed position of the oven.
Figure 2:
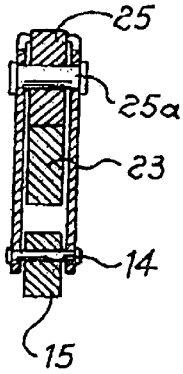
FIG. 2 shows a cross-section along the plane indicated by II—II in FIG. 1.

As illustrated (FIG. 3), the hinge according to the invention is arranged between the body 1*a* of an oven 1 and the door 1*b* for closing the same.

The hinge has a fixed part 10 comprising an arm 11 with an elbow bend and a cross-section substantially in the form of an overturned "U"; said arm has in its bottom part a recess 11*a* designed to be coupled with a corresponding projection on the oven wall la with which it engages.

At the opposite end 11*b* outside the oven, the arm 11 has a pin 12 with a substantially horizontal axis which forms the axis of rotation of the hinge and on which the body 21 of the movable part of the hinge itself is hinged; said body 21 has a cross-section in the form of a "C" and houses inside it a spring 22 acting under compression on an associated support 22*a* which in turn acts on one end 23*b* of a movable arm 23, the other end of which is free and shaped in the manner of a hook 23*a* designed to engage with a roller 25 mounted idle on a horizontal pin 25*a* arranged inside the fixed arm 11 between the two walls of the "U".

On its upper surface the movable arm 23 also has a relief 24 with inclined sides 24*a*, which is designed to come into contact with said roller 25 so that the interference between the upper surface 24*b* of the relief and the roller 25 produces a predetermined friction such that a certain force is required in order to open the oven door; similarly the contact of the inner side 24*a* against the same roller 25 is designed to cause a braking action of the door in the partially open position for cooking with the spit as described further below with reference to operation of the hinge.

The bottom surface of the fixed arm 11 (FIG. 3) is also provided with a pin 14 on which there is hinged one end of a pawl 15 designed to be inserted in abutment against a corresponding projection 23*c* extending towards the outside from the bottom surface of the movable arm 23; as will become clearer below with reference to operation of the hinge, this pawl 15 enables the movable arm 23 and the fixed arm 11 to be made integral (FIG. 4) in order to pull out the door from the oven body.

Operation of the hinge is as follows:

when the door 1*b* is in the closed condition (FIG. 3), the particular configuration of the relief 24 of the arm 23 ensures the necessary force for pushing the door against the contact seal of the oven so that no air can pass through;

when partially opening the door 1*b* it is possible to bring the movable arm 23 into a position such that the roller 25 rests on the inner side 24*a* of the projection 24, counterbalancing the thrusting force component of the spring 22 and thus keeping the partially open position of the door stable, which is particularly useful in the case of cooking with the spit (this configuration known per se is not illustrated);

when the door 1*b* is fully opened (FIG. 4), the movable arm 23 brings its free hook-shaped end 23*a* against the roller 25, thus acting as an end-of-travel safety stop preventing flipping over of the said door.

Figure 4:
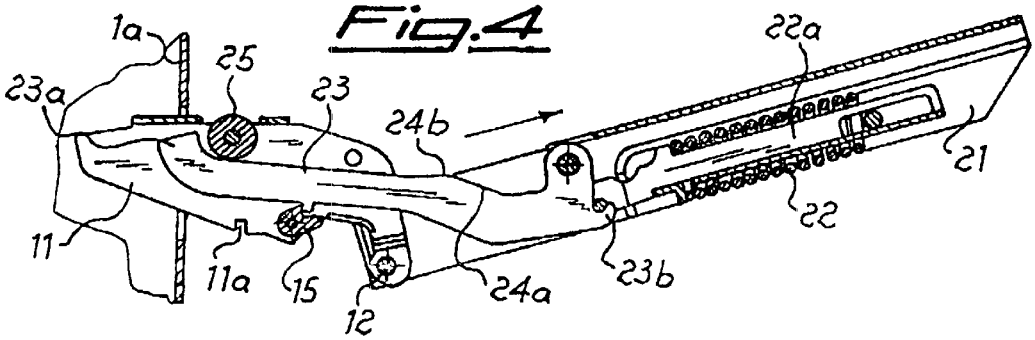
FIG. 4 shows a partially sectioned side view of the hinge according to FIG. 1 in the position extracted from the oven body.

Finally, as illustrated in FIG. 4, it is possible to open the door at a suitable angle which allows the operator to rotate the pawl 15 in a clockwise direction until it engages with the projection 23*c* of the movable lever 23 and causes fastening of the said movable arm to the fixed arm 11; in this condition it is therefore possible to separate the door 1*b* from the body 1*a* of the oven since the fixed arm may be disengaged from its anchoring seat and pulled out integrally with the movable arm without the risk of sudden movements of the hinge due to the spring 22 and prevented by the opposing action of the pawl 15.

Figure 5:
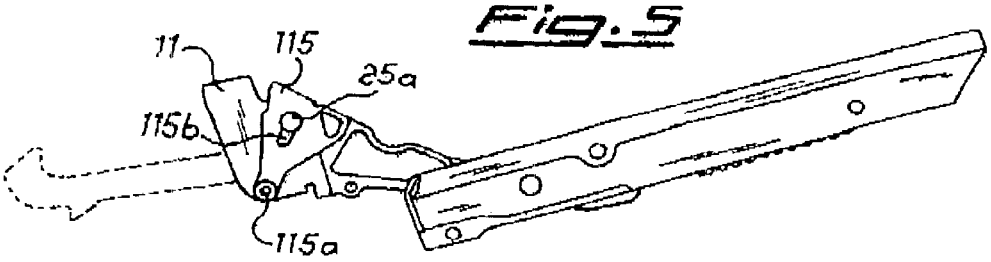
FIG. 5 shows a side view of a second example of embodiment of the hinge according to the invention.
Figure 6:
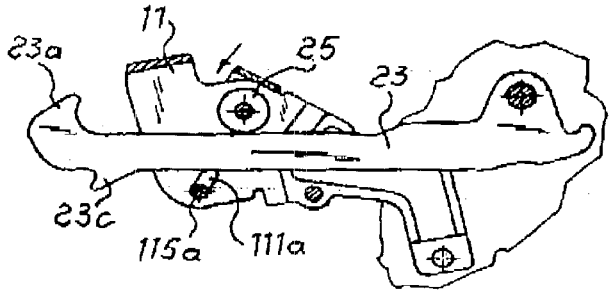
FIG. 6 shows a partially sectioned side view of the detail of the element for relative fastening of the two arms in the non-operating position.
Figure 7:
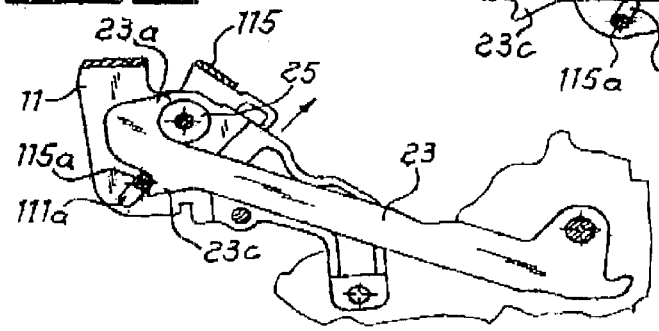
FIG. 7 shows a view similar to that of FIG. 6 with element for relative fastening of the two arms in the engaged position for extraction of the hinge.

FIGS. 5, 6 and 7 show a further embodiment of the hinge according to the invention in which the arm 11 has, externally mounted on it, a slider 115 substantially in the form of an "overturned U", the sides of which are connected in an eyelet 111*a* of the arm 11 (FIG. 7); the movement of the slider 115 in the transverse direction is guided by an eyelet 115*b* formed in the said slider and having, passing through it, the pin 25*a* supporting the roller 25.

As shown in FIG. 6, under normal working conditions, the slider is pushed downwards so that the pin 115*a* does not interfere with the path of the extension 23*c* of the arm 23, while (FIG. 7), when the hinge is in the totally open condition with the hook-shaped end of the arm 23 in contact with the roller 25, raising of the slider 115 causes the translation of the pin 115*a* until it engages with said projection 23*c* and the consequent relative fastening of the movable arm 23 and the fixed arm 11, which allows the door to be pulled out in totally safe conditions.

It is therefore obvious how with the hinge according to the invention it is possible to maintain the perfect and complete functioning capability of a hinge with a movable arm, but without the latter being visible and without the dimensions of the hinge being altered, thus allowing the hinge according to the invention to be mounted in place of hinges of the conventional type without the need for substantial modifications to the various component parts and the walls of the oven and the door.

In addition, it is also possible to eliminate the element supporting the roller, which in conventional hinges consisted of an additional body to be fastened to the oven body.

Although not shown, it is also possible to limit the system for actuation of the fixed arm 11 to a simple flat element carrying the pivot pins of the roller 25 and the pawl 15.

FIGS. 8*a* and 8*b* show a further embodiment of the pawl 15 in a non-operating position and in a position for fastening to the movable arm 23, respectively.

In this configuration the pin 14 of the pawl 15 is housed in an eyelet 211, extending in the vertical direction, of the fixed arm 11; in this way the rotation of the pawl causes a simultaneous displacement of the pin 14 from a bottom end-of-travel position, corresponding to a non-operative position of the pawl, to an upper end-of-travel position, corresponding to a condition where the pawl is engaged with the arm 23 for extraction of the hinge.

In a preferred embodiment the surface of the pawl opposite to that for engagement with the arm 23 has a lowered surface 14*a* designed to bear against a stop 14*b* fixed to the arm 11.

FIG. 9 shows a further embodiment of the two arms 1111 and 123 of the hinge, the respective side walls 1111*a* and 123*a* of which are in this case formed with an opposing frustoconical section so that the gradual extraction of the movable arm 123 from the fixed arm 1111, during normal opening of the door, causes the mutual engagement of the movable arm 123 and the fixed arm 111 with a consequent frictional opposing force gradually increasing with the opening rotation of the door.

This allows a reduction in the load of the compensating spring 22 and therefore the force which the user must apply in order to bring the door back into the position for closing the oven.

What is claimed is:

1. Hinge for connecting doors to ovens which comprises a fixed arm engageable with the body of the oven, a movable part which is hinged on said fixed arm and on which one end of a movable arm is pivotably mounted, and slider fastening means for fastening the movable arm to the fixed arm, wherein said slider fastening means are movable from a position disengaged from an element of the movable arm to a position engaged with said element so as to allow extraction of the hinge together with the door.

2. Hinge according to claim 1, wherein said fixed arm has a cross-section in the form of an overturned U between the walls of which an idle roller is located and in that said movable arm is arranged inside said fixed arm.

3. Hinge according to claim 2, wherein said movable arm has a free hook-shaped end for engagement with the said roller integral with the fixed arm.

4. Hinge according to claim 1, wherein a bottom surface of the movable arm is provided with an extension designed to cooperate with said slider fastening means.

5. Hinge according to claim 1, wherein said slider fastening means, comprises a slider substantially in the form of an overturned U which is arranged on the outside of the fixed arm and the sides of which are connected in the transverse direction by a pin sliding in an eyelet of the fixed arm.

6. Hinge according to claim 5, wherein said slider is guided, during its movement in the transverse direction, by an eyelet having, passing through it, the pin supporting the roller.

7. Hinge according to claim 5, wherein said slider is arranged on the outside of the fixed arm.

8. Hinge according to claim 5, wherein said slider is arranged on the inside of the fixed arm.

* * * * *